United States Patent [19]

Pamment

[11] 4,456,141

[45] Jun. 26, 1984

[54] WASTE CONTAINERS

[75] Inventor: Noel G. Pamment, Strathmore, Australia

[73] Assignee: Industrial Containers Pty. Ltd., Cnr. Moore, Victoria, Australia

[21] Appl. No.: 323,148

[22] Filed: Nov. 19, 1981

[51] Int. Cl.[3] ..... B65D 90/00; B65D 51/18

[52] U.S. Cl. ..... 220/1 T; 220/254; 220/335

[58] Field of Search ..... 220/1 T, 254, 335, 263, 220/334

[56] References Cited

U.S. PATENT DOCUMENTS 2,041,038 5/1936 Wisner ..... 220/263

4,088,071 5/1978 Cruse et al. ..... 220/254

4,342,402 8/1982 Junghes ..... 220/1 T

*Primary Examiner*—George T. Hall

*Attorney, Agent, or Firm*—James Creighton Wray

[57] ABSTRACT

A lid for an industrial waste container comprises a first lid section which is of relatively rigid, heavy construction and which is hinged to one side of the container. The first lid section defines an access opening to the container, which access opening is closed by a second lid section of relatively light weight. The second lid portion is hinged to the first lid section and a releasable catch is provided to releasably secure the first lid section in a closed position. Biasing means are provided to bias open the second lid section when the catch is released.

14 Claims, 6 Drawing Figures

49
42

53
64
51
52
49
54
59
61
42
63
43
57
58
56
43
46
47
44
58
48
38
12

WASTE CONTAINERS

FIELD OF THE INVENTION

This invention relates to improvements in waste containers, and relates particularly to improvements in industrial waste containers.

BACKGROUND OF THE INVENTION

Large capacity industrial waste containers are commonly used around factories, warehouses, public buildings and other areas requiring waste disposal facilities. The commonly used containers are of substantially rectangular configuration having means on either end to enable a specially constructed vehicle to lift the container and dump is contents into the vehicle.

BACKGROUND ART

A common size of container provided for general use holds between two and four cubic yards of waste material. Such containers were originally designed with a hinged single closure lid, but because of the weight of the lid and inherent difficulties in opening a lid of such a size, a number of industrial waste containers are now provided with two, separately openable lids adjacent each other.

However, such container lids are also relatively heavy and difficult to open and, further, such lids can be extremely dangerous if not adequately supported in the open position. Because of the manner by which the containers are emptied into a refuse vehicle, the lid or lids must be of a rigid construction which facilitates emptying of the container without damaging or buckling the lid.

Industrial waste, food wastes and numerous other waste materials which are placed in waste containers can attract vermin and insects if the waste material is left exposed. Most constructions of waste containers at present used are provided with lids which do not completely seal the container and some lids are formed with openings at the corners thereof which allow access to the waste within the container thereby also allowing vermin and insects into the container. Such containers are therefore a health risk, particularly when used with food wastes and the like.

It is an object of the present invention to provide an improved construction of waste container which has a lid which is relatively easy to open and which, when closed, seals the container against flys and other insects and vermin.

It is a further object of the present invention to provide an improved lid for a waste container which will withstand the rigours of mechanical handling and emptying of the containers and yet permits easy access to the container for disposal of waste into the container.

A still further object of the present invention is to provide an improved construction of waste container lid which is relatively economical to produce.

SUMMARY OF THE INVENTION

According to one aspect of the invention there is provided a container lid for a waste container comprising a first lid part having a peripheral edge portion to engage side edges of the container defining the container opening, the first lid part having means cooperating with hinge means on the container to pivotally attach the first lid part to the container, and a second lid part pivotally attached to the first lid part and adapted to close an access opening in the first lid part, the second lid part being formed of relatively light weight material permitting relatively easy opening of the second lid part, and means to maintain the second lid part in a closed position.

In a preferred construction, the second lid part comprises a metal or fibreglass lid arranged to close over the access opening in the first lid part. A handle is provided on the second lid part, the handle being movable to release a catch which holds the second lid part in the closed position. Alternatively, a separate latch or locking means may be provided.

It is also preferred that means are provided to assist the opening movement of the second lid part relatively to the first lid part. Such means may comprise a torsion bar engaged at its ends with the first and second lid parts. Alternatively a pneumatic, spring loaded arm which biases the second lid part to the open position may be provided. In another arrangement, a double acting pneumatic arm may operate as a shock absorber for both opening and closing movements.

In order that the invention will be more clearly understood two embodiments thereof will now be described with reference to the accompanying drawings.

DESCRIPTION OF THE PREFERRED EMBODIMENTS

Figure 1:
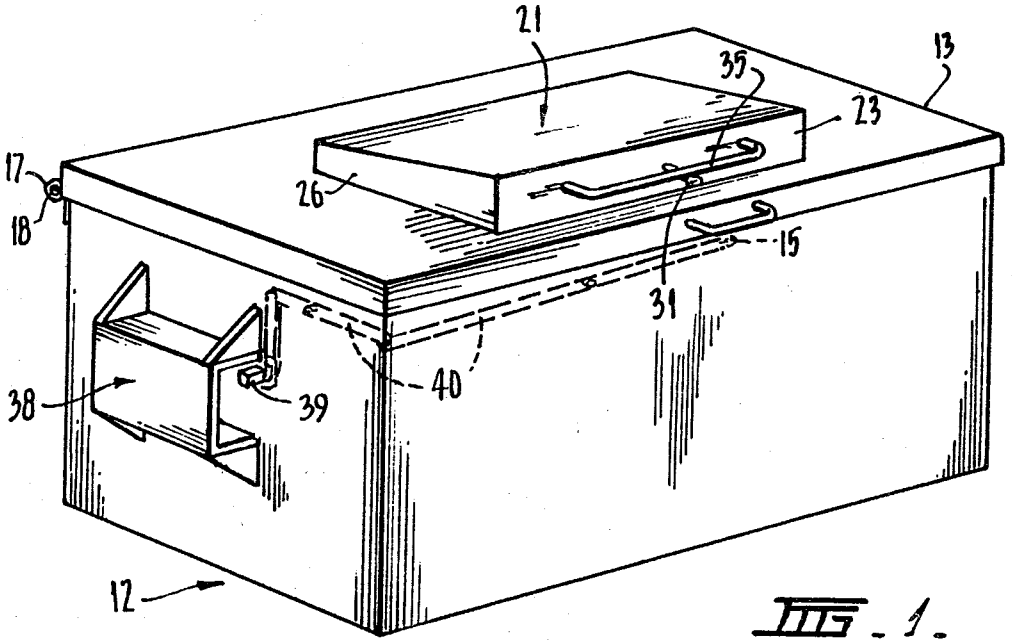
FIG. 1 is a perspective view of an industrial waste container according to the present invention.
Figure 2:
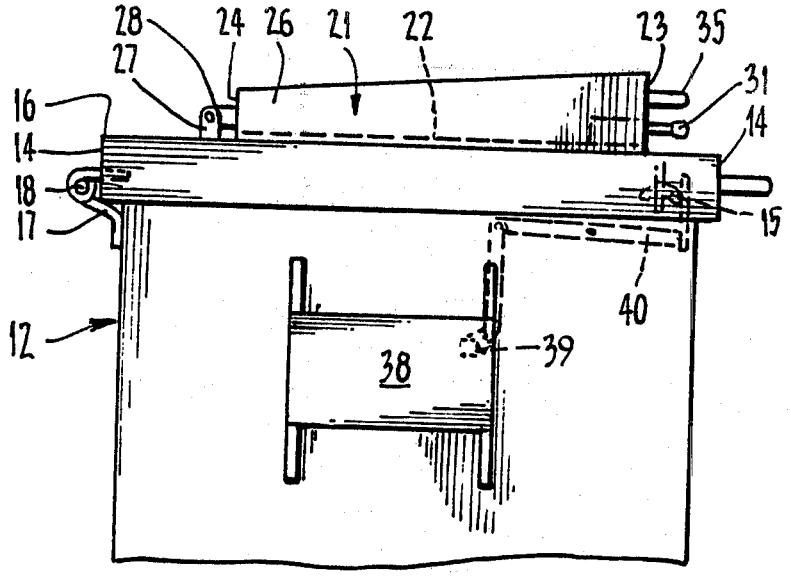
FIG. 2 is a side elevation illustrating the container lid of the invention.
Figure 3:
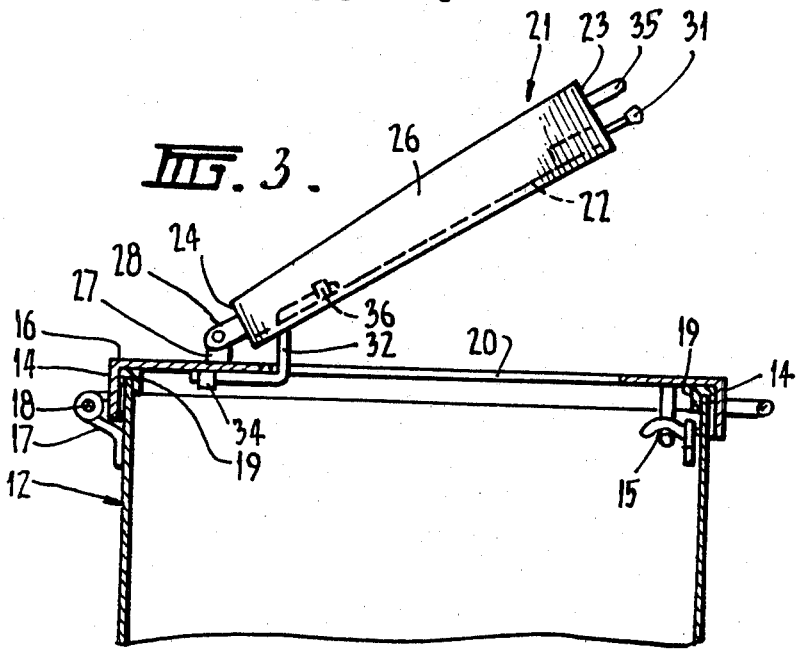
FIG. 3 is a cross-sectional side elevation of the container lid showing the second lid part in an open position.

Referring to the drawings, there is shown a four cubic yard metal waste container 12 having a main metal lid 13 comprising a heavy metal frame 14 carrying a metal sheet 16 forming the container lid. The frame 14 has at least two pivot brackets 17 which engage over a hinge pin 18 extending along a rear edge of the top of the container 12 to enable the metal lid 13 to pivot about the hinge pin.

A sealing strip 19 formed of rubber, synthetic plastic or similar material, is secured either to the lid frame 14 or to the upper edges of the container walls so as to seal the opening of the container 12 when the main lid 13 is in the closed position as illustrated. Suitable locking means 15, are provided on the main lid and the container to securely lock the lid 13 in the closed position.

Access to the interior of the container 12 is provided through an access opening 20 closed by a second lid part 21 which is pivoted to the main lid 13. The second lid part 21 is preferably formed of a fibreglass material with a peripheral metal frame 22 extending around the bottom edge thereof. The second lid part 21 is of rectangular plan and has substantially vertical front, rear and side walls 23, 24 and 26, respectively with a top wall extending from the front wall 23 downwardly to the rear wall 24. If desired the front wall 23 may have an upper section which slopes rearwardly to display a name, trade mark or the like on the sloping portion of the front wall.

The second lid portion 21 is hinged to the main lid 13 by means of brackets 47 extending upwardly from the main lid 13 and engaged by pins or lugs 28 extending from the rear of the frame 22 of the second lid part 21. A sealing strip of rubber, synthetic plastic or the like may be provided around the edge of the frame 22 of the second lid part 21 to ensure a seal between the lid parts. A suitable latch 29 operated by a lever 31 on the front wall 23 of the second lid enables that lid to be secured in the closed position on the main lid 13. If desired, a handle 35 may have a releasable catch operated by a lifting movement of the handle 35 to enable the lid to be raised relatively easily without the necessity for the lever 31 to be grasped and moved.

One or more Z-shaped torsion bars 32 are attached between the first and second lid parts and are adapted to assist the opening and/or closing movement of the second lid part. Preferably, two torsion bars are provided and engage under brackets 34, 36 on the main and second lid parts, respectively to locate them in operative position.

The lid construction of the present invention enables waste containers to be insect-proof and, at the same time, allows relatively easy access to the container for disposal of waste thereinto. The operation of the torsion bar, together with the releasable catch enables the second lid part to be opened with very little effort and without necessarily requiring actuation of a latch or the like by a users hands.

In use of the container, and during emptying of the waste container 12, the locking means 15 securing the main lid 13 is released and a mechanized waste dumping vehicle engages with lifting sockets 38 at each side of the container and lifts the container to dump the waste into the vehicle through the main container opening in a manner which is known in the art. The second lid part 21, being held securely to the main lid part 13 by the latch 29 is protected from damage which may otherwise be caused by mishandling of the container, by the rigid construction of the main lid part.

If desired, the locking means 15 securing the main lid part to the container may be automatically operated on insertion of the waste vehicle lifting mechanism into the lifting sockets 38 on the container. Thus, a suitable lever or cam 39 mounted on the wall of the containers 12 may be pivoted by the waste vehicle lifting arms to automatically release the locking means 15 securing the main lid part through a series of levers 40. A strong spring bias may be provided to ensure that the locking means 15 is only released by exertion of a force on the lever or cam 39 equivalent to that provided by the use of the lifting arms. The spring biased lever or cam 39 may operate the locking means located internally of the container, as illustrated, or alternatively, a catch mechanism can be secured to the outside of the container.

Figure 4:
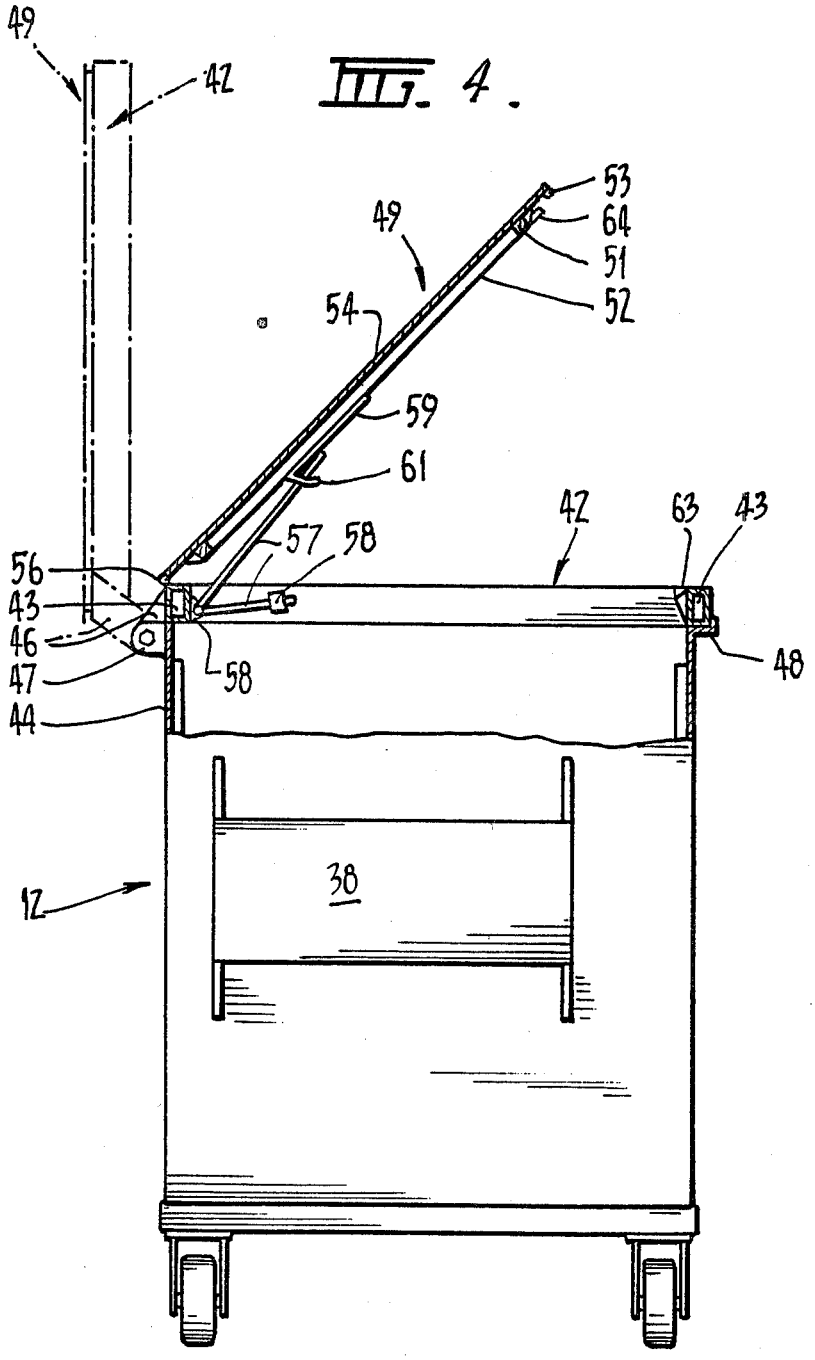
FIG. 4 is a part-sectional side elevational view of a modified construction of container and lid according to the invention.
Figure 5:
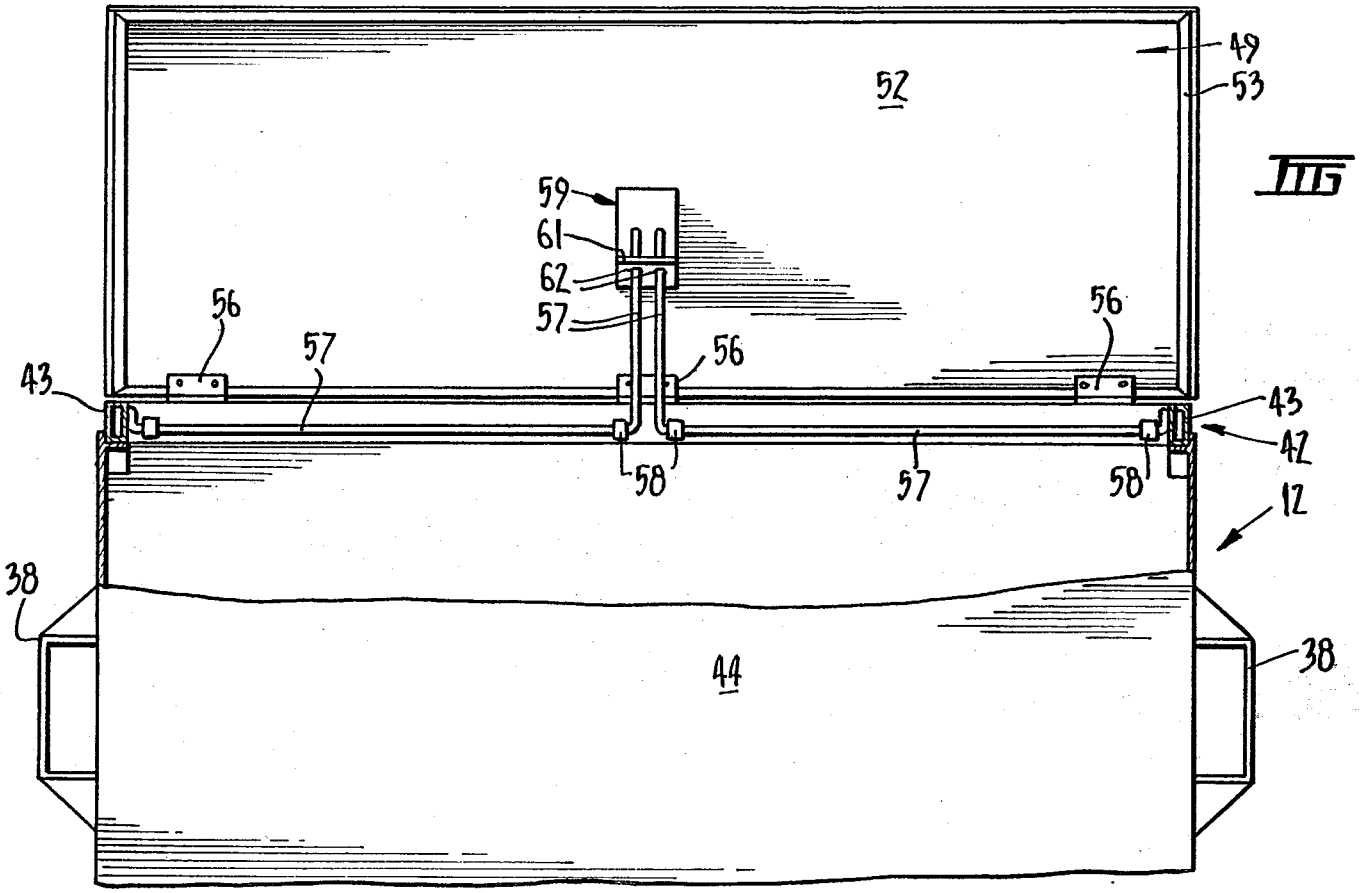
FIG. 5 is a cross-sectional front elevational view of the container and lid of FIG. 4 with the lid in the fully open position.
Figure 6:
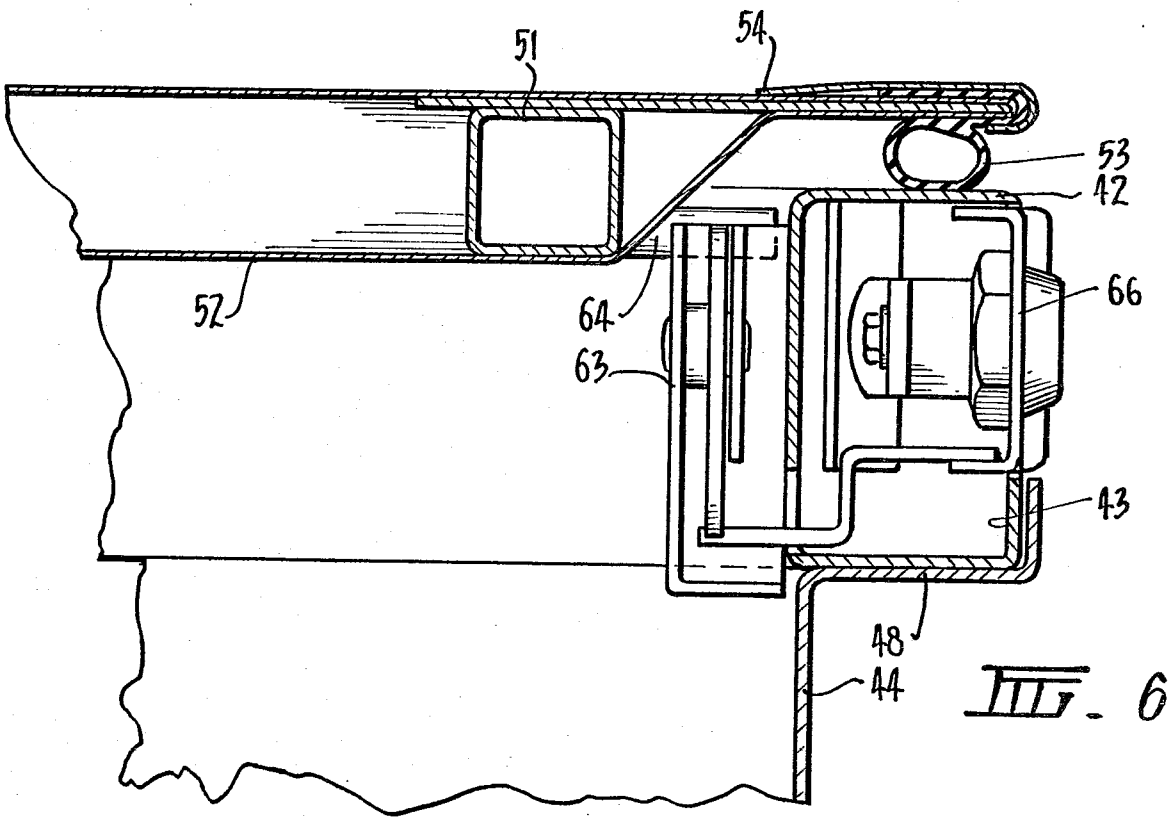
FIG. 6 is a detail view of the lid construction and showing one form of lid lock.

Referring to FIGS. 4 to 6 of the drawings, there is illustrated a modified construction of container lid for an industrial waste container 12. The lid of this embodiment comprises a peripheral rigid frame 42 formed of welded rectangular sectioned tubular frame members 43. The rigid frame 42 is pivoted to the container body 44 by a pair of hinge brackets 46 extending rearwardly of the frame 42 and cooperating with complementary brackets 47 on the container body 44 (most clearly shown in FIG. 4).

The upper peripheral edge of the container body 44 is provided with a frame receiving ledge 48 onto which the rigid frame 42 sits when in the closed position.

A secondary lid portion 49 is hinged to the rigid frame 42 to permit easy access to the interior of the container body 44. The secondary lid portion 49 is formed with a substantially rectangular frame 51, of square cross-section tubular steel members. The frame 51 has a sheet metal lower panel 52 secured thereto, the lower panel 52 preferably being of galvanized sheet steel. A peripheral rubber seal 52 is engaged with the lower panel 52 and an upper panel 54 engages therewith and with the frame 51, the edges of the upper panel 54 being inwardly turned to hold the seal 53 in position. The rubber seal 53 is adapted to engage with the upper surface of the rigid frame 42 when the secondary lid portion 49 is in the closed position relative to the frame 42. The secondary lid portion 49 is hinged to the rigid frame 42 by means of three spaced hinges 56. The secondary lid portion 49 is urged into the open position by a pair of torsion bars 57 extending along the rear frame member of the rigid frme 42, and supported in position by saddles 58. One end of each torsion bar 57 extends a short distance along one of the side members of the rigid frame 42 while the other end of each torsion bar engages with a wear plate 59 on the lower panel 52 of the secondary lid portion 49. The wear plate 59 is provided with an angularly disposed flange portion 61 having a pair of slotted holes 62 therein through which the torsion bars 57 pass. The dimensions of the slotted holes 62 is such that, when the secondary lid portion 49 extends at 90° to the rigid frame 42, the torsion bars 57 engage the edges of the slotted holes 62 thus preventing further opening movement of the secondary lid portion 49.

A catch 63 is fixed to the rigid frame 42 on the front frame member thereof and is adapted to be engaged by a locking bar 64 fixed to the secondary lid portion 49. The catch 63 comprises a simple, to position, over-centre catch which, when engaged by the locking bar 64, operates to secure the bar 64 to the catch to prevent opening of the secondary lid portion 49. The catch 63 may be released by a handle 66 pivotally mounted on the front of the rigid frame 42. If desired, a key lock may be provided to prevent unauthorized opening of the secondary lid portion 49.

In use, when the catch 63 is released, the torsion bars 57 automatically open the secondary lid portion 49 to the position illustrated in FIG. 4. However, there is sufficient tension in the torsion bars 57 so that, if the lid is opened to a 90° position the torsion bars will maintain the lid in that open position. When the lid is closed so that the locking bar 64 engages with the catch 63, the lid is secured to the rigid frame 42.

The container 44 is emptied in the manner known in the art by means of a mechanical waste dumping vehicle engaging with lifting sockets 38 at each side of the container body 44. As the container is lifted and inverted the rigid frame 42 pivots about the hinge brackets 47 so that the combined frame and secondary lid portion opened to permit the contents of the container to be dumped into the waste collection vehicle. In normal operation, however, the rigid framme 42 is of such a weight that manual opening thereof is relatively difficult.

I claim:

1. A industrial container lid for a waste container comprising a first lid part having a peripheral edge portion to engage side edges of the container defining the container opening, the first lid part having means cooperating with hinge means on the container to pivotally attach the first lid part to the container, and a second lid part attached to the first lid part and adapted to hold open an access opening in the first lid part, the second lid part being formed of relatively light weight material permitting relatively easy opening of the second lid part, and latch means to maintain the second lid part in a closed position.

2. A container lid according to claim 1 wherein means are provided to maintain said second lid part in an open position when moved thereto from said closed position.

3. A container lid according to claim 2 wherein said means to maintain the second lid part in said open position comprises one or more torsion bars co-acting with said first lid part and said second lid part.

4. A container lid according to claim 1 and including sealing means between the peripheral edge portion of said first lid part and the container side edges.

5. A container lid according to claim 1 wherein said second lid part is formed of fibreglass with side edge portions adapted to engage with a top surface of said first lid part about the periphery of the access opening therein.

6. A container lid according to claim 1 wherein said means to maintain said second lid part in the closed position includes a latch on the second lid part to engage with the first lid part, and handle means on the second lid part to release the latch.

7. A container lid according to claim 1 and including sealing means between the peripheral edge of said second lid part and an upper surface of said first lid part.

8. A waste container having a container lid according to claim 1.

9. A waste container according to claim 8 and including locking means to secure the first lid part in a closed position on the container, said locking means including a lever or cam mounted on a side wall of the container and movable on engagement by container lifting arms of a mechanized waste disposal vehicle to release the locking means to allow the first lid part to be opened.

10. In an industrial container having side walls, a bottom wall, means enabling the contents of the container to be emptied by a mechanized refuse vehicle, a main lid part engaged, in the closed position with upper edges of the side walls, the main lid part being hinged to one of the side walls and a second lid part hinged to the main lid part, the improvement comprising said main lid part being constituted by a relatively rigid peripheral frame which carries said second lid part, biasing means biasing said second lid part to an open position relative to said peripheral frame, sealing means comprising a resilient gasket against which the second lid part seals when in the closed position and releasable latching means retaining the second lid part in the closed position and operable to release the second lid part which moves to the open position under the influence of said biasing means.

11. The container of claim 10 wherein said biasing means comprises a pair of torsion bars mounted to said rigid peripheral frame and having end portions thereof engaging a wear plate on the second lid part thereby biasing said lid to an open position.

12. The container of claim 11 wherein said wear plate includes an outstanding flange having a pair of slotted holes therein through which said torsion bars engage, said slotted holes being of dimensions to restrict the degree of opening of said secondary lid.

13. The container of claim 10 wherein said sealing means is a flexible seal member secured to and carried by said second lid part and engages an upper surface of said peripheral frame.

14. The container of claim 10 wherein locking means secure the main lid part in a closed position on the container, said locking means including a lever or cam mounted on a side wall of the container and movable on engagement by container lifting arms of the mechanized refuse vehicle to release the locking means to allow the main lid part to be opened when the container is being emptied.

* * * * *